US011535922B2

(12) United States Patent
Makimizu et al.

(10) Patent No.: US 11,535,922 B2
(45) **Date of Patent: *Dec. 27, 2022**

(54) METHOD FOR MANUFACTURING HIGH-STRENGTH GALVANIZED STEEL SHEET

(71) Applicant: JFE Steel Corporation, Tokyo (JP)

(72) Inventors: Yoichi Makimizu, Tokyo (JP); Gentaro Takeda, Tokyo (JP); Hiroshi Hasegawa, Tokyo (JP); Yoshimasa Himei, Tokyo (JP); Yoshikazu Suzuki, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 180 days.

This patent is subject to a terminal disclaimer.

(21) Appl. No.: 16/343,831

(22) PCT Filed: Sep. 14, 2017

(86) PCT No.: PCT/JP2017/033180
§ 371 (c)(1),
(2) Date: Apr. 22, 2019

(87) PCT Pub. No.: WO2018/079124
PCT Pub. Date: May 3, 2018

(65) Prior Publication Data

US 2019/0242000 A1 Aug. 8, 2019

(30) Foreign Application Priority Data

Oct. 25, 2016 (JP) ..... JP2016-208421

(51) Int. Cl.
*C23C 2/02* (2006.01)
*C23C 2/06* (2006.01)
(Continued)

(52) U.S. Cl.
CPC ..... *C23C 2/02* (2013.01); *C21D 1/76* (2013.01); *C21D 9/46* (2013.01); *C21D 9/561* (2013.01);
(Continued)

(58) Field of Classification Search
CPC .... C23C 2/02; C23C 2/06; C23C 2/28; C23C 2/40; C21D 1/76; C21D 9/46;
(Continued)

(56) References Cited

U.S. PATENT DOCUMENTS 9,340,859 B2 5/2016 Miyata et al.
2009/0123651 A1 5/2009 Okada
(Continued)

FOREIGN PATENT DOCUMENTS

CN 104245996 A 12/2014
EP 2716773 A1 4/2014
(Continued)

OTHER PUBLICATIONS

Fonstein; Advanced High Strength Sheet Steels; Aug. 14, 2015; Springer; p. 19-21 (Year: 2015).*
(Continued)

*Primary Examiner* — Anthony M Liang
(74) *Attorney, Agent, or Firm* — RatnerPrestia

(57) ABSTRACT

Provided is a method for manufacturing a high-strength galvanized steel sheet. Heating in a first half of oxidizing treatment is performed at a temperature of 400° C. to 750° C. in an atmosphere having a particular $O_2$ concentration and a particular $H_2O$ concentration, and heating in a second half of the oxidizing treatment is performed at a temperature of 600° C. to 850° C. in an atmosphere having a particular $O_2$ concentration and a particular $H_2O$ concentration. Subsequently, heating in a heating zone for reduction annealing is performed to a temperature of 650° C. to 900° C. at a
(Continued)

particular heating rate in an atmosphere having a particular $H_2$ concentration and a particular $H_2O$ concentration with the balance being $N_2$ and inevitable impurities, and soaking in a soaking zone for the reduction annealing is performed in an atmosphere having a particular $H_2$ concentration and a particular $H_2O$ concentration with the balance being $N_2$ and inevitable impurities.

10 Claims, 1 Drawing Sheet

(51) Int. Cl.

| | |
|---|---|
| ***C23C 2/40*** | (2006.01) |
| ***C22C 38/02*** | (2006.01) |
| ***C22C 38/04*** | (2006.01) |
| ***C22C 38/06*** | (2006.01) |
| ***C22C 38/00*** | (2006.01) |
| ***C22C 38/60*** | (2006.01) |
| ***C22C 38/14*** | (2006.01) |
| ***C22C 38/12*** | (2006.01) |
| ***C22C 38/16*** | (2006.01) |
| ***C22C 38/38*** | (2006.01) |
| ***C22C 38/08*** | (2006.01) |
| ***C22C 38/32*** | (2006.01) |
| ***C22C 38/28*** | (2006.01) |
| ***C22C 38/26*** | (2006.01) |
| ***C22C 38/22*** | (2006.01) |
| ***C21D 9/46*** | (2006.01) |
| ***C21D 1/76*** | (2006.01) |
| ***C23C 2/28*** | (2006.01) |
| ***C21D 9/56*** | (2006.01) |

(52) U.S. Cl.
CPC ..... *C22C 38/00* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/26* (2013.01); *C22C 38/28* (2013.01); *C22C 38/32* (2013.01); *C22C 38/38* (2013.01); *C22C 38/60* (2013.01); *C23C 2/06* (2013.01); *C23C 2/28* (2013.01); *C23C 2/40* (2013.01)

(58) Field of Classification Search
CPC ..... C21D 9/561; C22C 38/00; C22C 38/008; C22C 38/02; C22C 38/04; C22C 38/06; C22C 38/08; C22C 38/12; C22C 38/14; C22C 38/16; C22C 38/22; C22C 38/26; C22C 38/28; C22C 38/32; C22C 38/38; C22C 38/60
See application file for complete search history.

(56) References Cited

U.S. PATENT DOCUMENTS

| | | | | |
|---|---|---|---|---|
| 2012/0037281 | A1* | 2/2012 | Ono | C22C 38/002 148/533 |
| 2014/0174608 | A1* | 6/2014 | Miyata | C23C 2/02 148/243 |
| 2014/0234655 | A1 | 8/2014 | Takashima et al. | |
| 2015/0013851 | A1* | 1/2015 | Takahashi | C23C 2/02 148/508 |
| 2015/0345002 | A1 | 12/2015 | Blumenau et al. | |
| 2016/0102379 | A1* | 4/2016 | Makimizu | C22C 38/50 148/503 |
| 2016/0304980 | A1 | 10/2016 | Rotole et al. | |
| 2016/0304982 | A1* | 10/2016 | Makimizu | C23C 2/28 |
| 2017/0253943 | A1 | 9/2017 | Makimizu et al. | |
| 2019/0242000 | A1 | 8/2019 | Makimizu et al. | |

FOREIGN PATENT DOCUMENTS

| | | | | |
|---|---|---|---|---|
| EP | 2840161 | A1 | 2/2015 | |
| EP | 3000908 | A1 | 3/2016 | |
| EP | 3428303 | A1 | 1/2019 | |
| JP | 55122865 | A | 9/1980 | |
| JP | 04202630 | A | 7/1992 | |
| JP | 04202631 | A | 7/1992 | |
| JP | 04202632 | A | 7/1992 | |
| JP | 04202633 | A | 7/1992 | |
| JP | 04254531 | A | 9/1992 | |
| JP | 04254532 | A | 9/1992 | |
| JP | 0734210 | A | 2/1995 | |
| JP | 2004211157 | A | 7/2004 | |
| JP | 2005060742 | A | 3/2005 | |
| JP | 2007291498 | A | 11/2007 | |
| JP | 2016053211 | A | 4/2016 | |
| WO | 2014188697 | A1 | 11/2014 | |
| WO | WO-2015087549 | A1 * | 6/2015 | C21D 9/46 |
| WO | 2016038801 | A1 | 3/2016 | |

OTHER PUBLICATIONS

Chinese Office Action for Chinese Application No. 201780065491.X, dated Jan. 12, 2021, with Concise Statement of Relevance of Office Action, 8 pages.
Chinese Office Action with Search Report for Chinese Application No. 201780065491.X, dated Jul. 30, 2020, 11 pages.
Korean Office Action for Korean Application No. 10-2019-7011111, dated Jul. 25, 2020, with Concise Statement of Relevance of Office Action, 7 pages.
Non Final Office Action for U.S. Appl. No. 16/083,678, dated Jul. 10, 2020, 16 pages.
International Search Report and Written Opinion for International Application No. PCT/JP2017/033180, dated Oct. 2, 2017, 6 pages.
Extended European Search Report for European Application No. 17864391.2, dated Jun. 28, 2019, 9 pages.

* cited by examiner

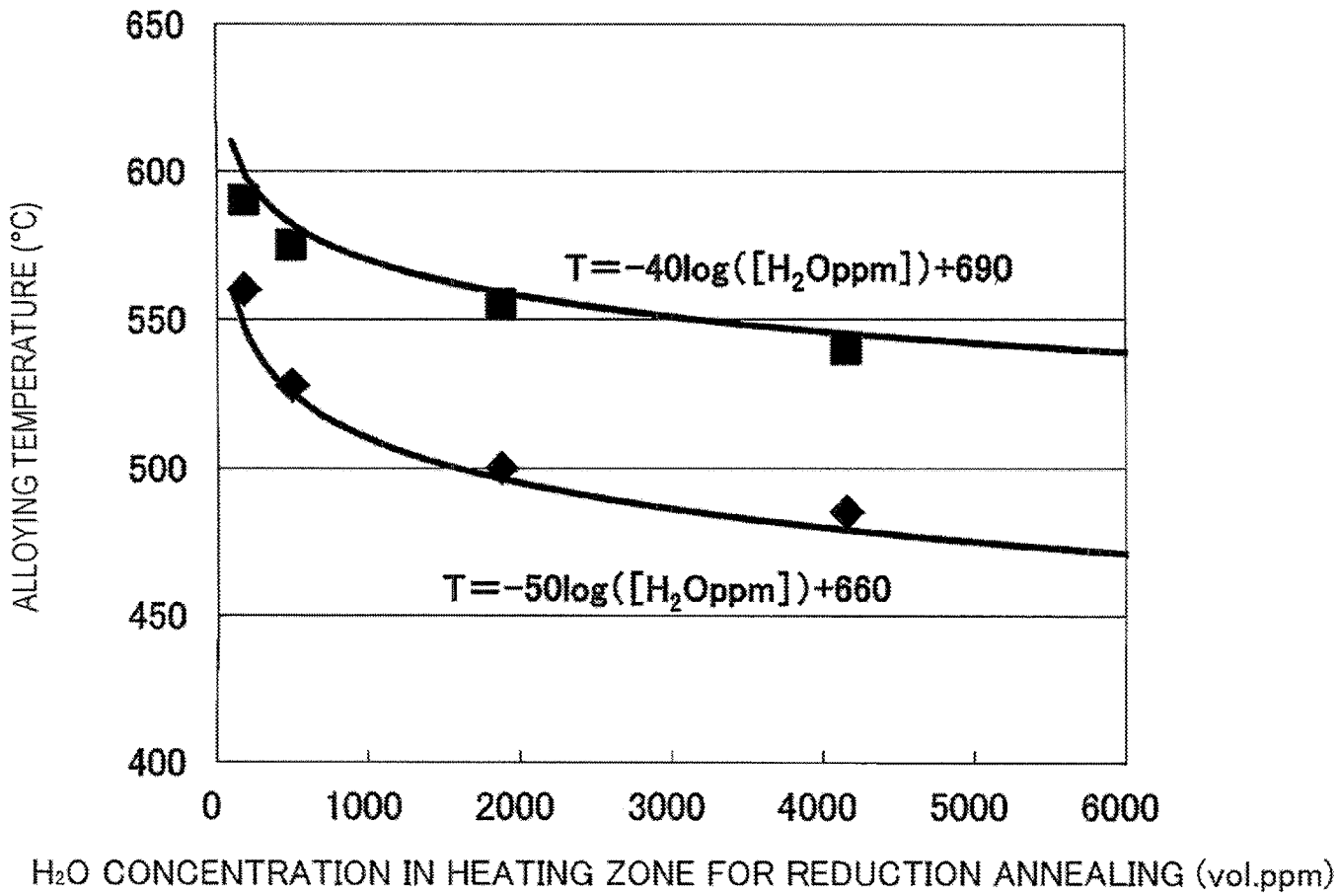
650
600
550
500
450
400
ALLOYING TEMPERATURE (°C)
0
1000
2000
3000
4000
5000
6000
H2O CONCENTRATION IN HEATING ZONE FOR REDUCTION ANNEALING (vol.ppm)
T=−40log([H2Oppm])+690
T=−50log([H2Oppm])+660

METHOD FOR MANUFACTURING HIGH-STRENGTH GALVANIZED STEEL SHEET

CROSS REFERENCE TO RELATED APPLICATIONS

This is the U.S. National Phase application of PCT/JP2017/033180, filed Sep. 14, 2017, which claims priority to Japanese Patent Application No. 2016-208421, filed Oct. 25, 2016, the disclosures of these applications being incorporated herein by reference in their entireties for all purposes.

FIELD OF THE INVENTION

The present invention relates to a method for manufacturing a high-strength galvanized steel sheet having a high-strength steel sheet containing Si as a base material.

BACKGROUND OF THE INVENTION

Nowadays, a surface-treated steel sheet, which is manufactured by providing a raw material steel sheet with rust prevention capability, in particular, a galvanized steel sheet or a galvannealed steel sheet having excellent rust prevention capability, is used in industrial fields of, for example, automobiles, home electric appliances, and building materials. In addition, from the viewpoint of improving the fuel efficiency and collision safety of automobiles, there is a trend toward using a high-strength steel sheet for automobiles to decrease the weight of automobile bodies while increasing the strength of the bodies by decreasing the thickness of a material for automobile bodies as a result of increasing the strength of the material.

Generally, a galvanized steel sheet is manufactured by using a thin steel sheet, which is manufactured by performing hot rolling and cold rolling on a slab, as a base material, by performing recrystallization annealing on the base steel sheet by using an annealing furnace in a CGL, and by performing a galvanizing treatment on the annealed steel sheet. In addition, a galvannealed steel sheet is manufactured by further performing an alloying treatment on the galvanized steel sheet.

To increase the strength of the steel sheet, adding Si and Mn to the steel sheet is effective. However, when continuous annealing is performed, since Si and Mn are oxidized even if annealing is performed in a reducing atmosphere of $N_2$+$H_2$ gas in which the oxidation of Fe does not occur (that is, oxidized Fe is reduced), oxides of Si and Mn are formed in the outermost surface layer of the steel sheet. Since the oxides of Si and Mn cause a deterioration in wettability between molten zinc and the base steel sheet when a galvanizing treatment is performed, a bare spot often occurs in a steel sheet containing Si and Mn. In addition, even if a bare spot does not occur, there is a problem of poor coating adhesiveness.

As an example of a method for manufacturing a galvanized steel sheet which is manufactured by using a high-strength steel sheet containing large amounts of Si and Mn as a base material, Patent Literature 1 discloses a method in which reduction annealing is performed after an oxide film is formed on the surface of a steel sheet. However, in the case of Patent Literature 1, it is not possible to stably achieve good coating adhesiveness.

In response to such a problem, Patent Literature 2 through Patent Literature 8 disclose techniques for stably realizing the effect by specifying oxidization rate and reduction degree or by controlling oxidation conditions and reduction conditions on the basis of the thickness of an oxide film determined in an oxidation zone.

In addition, Patent Literature 9 through Patent Literature 12 disclose techniques in which gas components of an atmosphere such as $O_2$, $H_2$, and $H_2O$ are specified in an redox process.

PATENT LITERATURE

PTL 1: Japanese Unexamined Patent Application Publication No. 55-122865

PTL 2: Japanese Unexamined Patent Application Publication No. 4-202630

PTL 3: Japanese Unexamined Patent Application Publication No. 4-202631

PTL 4: Japanese Unexamined Patent Application Publication No. 4-202632

PTL 5: Japanese Unexamined Patent Application Publication No. 4-202633

PTL 6: Japanese Unexamined Patent Application Publication No. 4-254531

PTL 7: Japanese Unexamined Patent Application Publication No. 4-254532

PTL 8: Japanese Unexamined Patent Application Publication No. 7-34210

PTL 9: Japanese Unexamined Patent Application Publication No. 2004-211157

PTL 10: Japanese Unexamined Patent Application Publication No. 2005-60742

PTL 11: Japanese Unexamined Patent Application Publication No. 2007-291498

PTL 12: Japanese Unexamined Patent Application Publication No. 2016-053211

SUMMARY OF THE INVENTION

It was found that, in the case where the methods for manufacturing a galvanized steel sheet according to Patent Literature 1 through Patent Literature 8 are used, since oxides of Si and Mn are formed on the surface of a steel sheet when continuous annealing is performed, it is not always possible to achieve sufficient coating adhesiveness.

In addition, in the case where the manufacturing methods according to Patent Literature 9 and Patent Literature 10 are used, although there is an improvement in coating adhesiveness, there is a problem in which a so-called pickup phenomenon occurs, that is, an excessive amount of oxide scale generated in an oxidation zone adheres to rolls in a furnace interior, which results in dent flaws occurring in a steel sheet.

In the case of the manufacturing method according to Patent Literature 11, it was found that, although a pickup phenomenon is effectively inhibited, it is not always possible to achieve good workability or fatigue resistance. In addition, it was found that it is not possible to achieve good coating adhesiveness.

Patent Literature 12 discloses a technique for improving coating adhesiveness by controlling $H_2O$ concentration in an annealing furnace. However, it was found that, in the case where the $H_2O$ concentration in the whole furnace is simply controlled, there may be a deterioration in fatigue resistance properties due to excessive internal oxidation.

Aspects of the present invention have been completed in view of the situation described above, and an object according to aspects of the present invention is to provide a method for manufacturing a high-strength galvanized steel sheet excellent in terms of coating adhesiveness, workability, and fatigue resistance.

To increase the strength of steel, as described above, adding solid solution strengthening elements such as Si and Mn is effective. In addition, a high-strength steel sheet used in automobile applications, in which press forming is necessary, is required to have improved strength-ductility balance. In response to such a requirement, since there is an advantage in that Si and Mn increase the strength of steel without deteriorating the ductility of the steel, Si-containing steel is very effective as a high-strength steel sheet. However, in the case where a high-strength galvanized steel sheet is manufactured by using Si-containing steel or Si—Mn-containing steel as a base material, the following problems exist.

Si and Mn cause a deterioration in wettability between a steel sheet and molten zinc by forming oxides of Si and/or Mn on the outermost surface of the steel sheet in an annealing atmosphere. As a result, surface defects such as a bare spot occur. In addition, even if a bare spot does not occur, there is a significant deterioration in coating adhesiveness. This is considered to be because oxides of Si and/or Mn, which have been formed on the surface of the steel sheet, are retained at the interface between the coating layer and the steel sheet, which results in a deterioration in coating adhesiveness.

In addition, in the case of Si-containing steel, when an alloying treatment is performed after a galvanizing treatment has been performed, the reaction between Fe and Zn is inhibited. Therefore, it is necessary that an alloying treatment be performed at a comparatively high temperature to allow alloying to progress normally. However, in the case where an alloying treatment is performed at a high temperature, it is not possible to achieve sufficient workability.

It was found that the reason why it is not possible to achieve sufficient workability in the case where an alloying treatment is performed at a high temperature is because a retained austenite phase in steel, which is necessary for achieving satisfactory ductility, is disintegrated into a pearlite phase, which results in sufficient workability not being achieved. In addition, it was found that, in the case where a galvanizing treatment and an alloying treatment are performed after cooling has been performed to a temperature equal to or lower than the Ms temperature and reheating has been performed prior to a galvanizing treatment, since a martensite phase, which is necessary for achieving satisfactory strength, is tempered, it is not possible to achieve sufficient strength. As described above, in the case of Si-containing steel, there is a problem in that it is not possible to achieve the desired mechanical properties due to an increase in alloying temperature.

Moreover, although a method, in which reduction annealing is performed after oxidizing treatment has been performed, is effective for preventing the oxidation of Si from occurring on the outermost surface of a steel sheet, oxides of Si are formed along grain boundaries within the surface layer of the steel sheet. It was found that, in such a case, there is a deterioration in fatigue resistance. This is considered to be because a fatigue crack grows from the oxides formed at grain boundaries as an origin.

As a result of investigations on the basis of the facts described above, the following knowledge was obtained. In the case where a high-strength steel sheet containing Si and Mn is used as a base material, performing reduction annealing after an oxidizing treatment has been performed is effective for inhibiting Si and Mn, whose oxides cause a deterioration in wettability between the steel sheet and molten zinc, from being oxidized on the outermost surface of the steel sheet. At this time, by causing a difference in $O_2$ concentration in an atmosphere between the first and second halves of an oxidizing treatment, it is possible to prevent pickup from occurring due to iron oxides while ensuring a sufficient amount of iron oxides necessary to inhibit Si and Mn from being oxidized on the surface of the steel sheet. On the other hand, to avoid an alloying treatment being performed at a high temperature on Si-containing steel, utilizing the internal oxidation reaction of Si is effective. It is possible to improve workability and fatigue resistance by decreasing the alloying temperature as a result of controlling $H_2O$ concentration in a heating zone for reduction annealing subsequent to an oxidizing treatment to be high to promote the internal oxidation of Si due to oxygen provided from iron oxides which has been formed in an oxidizing treatment and, preferably, as a result of specifying the alloying temperature in relation to the $H_2O$ concentration in the heating zone. In addition, it is possible to improve coating adhesiveness. Moreover, it is possible to achieve excellent mechanical properties by controlling temperature variation in a soaking zone.

That is, it was found that it is possible to obtain a high-strength galvanized steel sheet excellent in terms of coating adhesiveness, workability, and fatigue resistance by performing an oxidizing treatment with a controlled $O_2$ concentration, by performing reduction annealing with a controlled $H_2O$ concentration, and, preferably, by performing an alloying treatment at a temperature controlled in accordance with the $H_2O$ concentration in a heating zone.

Aspects of the present invention have been completed on the basis of the knowledge described above and are characterized as follows.

[1] A method for manufacturing a high-strength galvanized steel sheet, the method including performing an oxidizing treatment, reduction annealing, and a galvanizing treatment in this order on a steel sheet having a chemical composition containing, by mass %, C: 0.3% or less, Si: 0.1% to 2.5%, Mn: 0.5% to 3.0%, P: 0.100% or less, S: 0.0100% or less, and the balance being Fe and inevitable impurities, in which heating in a first half of the oxidizing treatment is performed at a temperature of 400° C. or higher and 750° C. or lower in an atmosphere having an $O_2$ concentration of 1000 vol·ppm or more and an $H_2O$ concentration of 1000 vol·ppm or more, in which heating in a second half of the oxidizing treatment is performed at a temperature of 600° C. or higher and 850° C. or lower in an atmosphere having an $O_2$ concentration of less than 1000 vol·ppm and an $H_2O$ concentration of 1000 vol·ppm or more, in which heating in a heating zone for the reduction annealing is performed to a temperature of 650° C. or higher and 900° C. or lower at a heating rate of 0.1° C./sec or more in an atmosphere having an $H_2$ concentration of 5 vol. % or more and 30 vol. % or less and an $H_2O$ concentration of 500 vol·ppm or more and 5000 vol·ppm or less with the balance being $N_2$ and inevitable impurities, and in which soaking in a soaking zone for the reduction annealing is performed with a temperature variation of within ±20° C. for 10 seconds to 300 seconds in an atmosphere having an $H_2$ concentration of 5 vol. % or more and 30 vol. % or less and an $H_2O$ concentration of 10 vol·ppm or more and 1000 vol·ppm or less with the balance being $N_2$ and inevitable impurities.

[2] The method for manufacturing a high-strength galvanized steel sheet according to item [1] above, in which a relationship (the $H_2O$ concentration in the heating zone)> (the $H_2O$ concentration in the soaking zone) is satisfied.

[3] The method for manufacturing a high-strength galvanized steel sheet according to item [1] or [2] above, in which the $H_2O$ concentration in the heating zone is more than 1000 vol·ppm and 5000 vol·ppm or less, and the $H_2O$ concentration in the soaking zone is 10 vol·ppm or more and less than 500 vol·ppm.

[4] The method for manufacturing a high-strength galvanized steel sheet according to any one of items [1] to [3] above, in which the oxidizing treatment is performed by using a direct fired furnace (DFF) or a non-oxidation furnace (NOF), in which the first half of the oxidizing treatment is performed with an air ratio of 1.0 or more and less than 1.3, and in which the second half of the oxidizing treatment is performed with an air ratio of 0.7 or more and less than 0.9.

[5] The method for manufacturing a high-strength galvanized steel sheet according to any one of items [1] to [4] above, in which a difference in $H_2O$ concentration between upper and lower parts of a furnace in the heating zone for the reduction annealing is 2000 vol·ppm or less.

[6] The method for manufacturing a high-strength galvanized steel sheet according to any one of items [1] to [5] above, in which the galvanizing treatment is performed in a galvanizing bath having a chemical composition having an effective Al concentration in the bath of 0.095 mass % to 0.175 mass % with the balance being Zn and inevitable impurities.

[7] The method for manufacturing a high-strength galvanized steel sheet according to any one of items [1] to [5] above, in which the galvanizing treatment is performed in a galvanizing bath having a chemical composition having an effective Al concentration in the bath of 0.095 mass % to 0.115 mass % with the balance being Zn and inevitable impurities, and an alloying treatment is further performed at a temperature T (° C.) which satisfies a relational expression below for 10 seconds to 60 seconds.

$$-50\log([H_2O])+660 \leq T \leq -40\log([H_2O])+690$$

Here, $[H_2O]$ denotes the $H_2O$ concentration (vol·ppm) in the heating zone for the reduction annealing.

[8] The method for manufacturing a high-strength galvanized steel sheet according to any one of items [1] to [7] above, in which the chemical composition further contains, by mass %, one, two, or more of Al: 0.01% to 0.1%, Mo: 0.05% to 1.0%, Nb: 0.005% to 0.05%, Ti: 0.005% to 0.05%, Cu: 0.05% to 1.0%, Ni: 0.05% to 1.0%, Cr: 0.01% to 0.8%, B: 0.0005% to 0.005%, Sb: 0.001% to 0.10%, and Sn: 0.001% to 0.10%.

Here, in accordance with aspects of the present invention, the term "high strength" refers to a case of a tensile strength TS of 440 MPa or more. In addition, the meaning of the term "high-strength galvanized steel sheet" according to aspects of the present invention includes one which is manufactured by using a cold-rolled steel sheet or a hot-rolled steel sheet as a base material and one which is subjected to a galvanizing treatment and, optionally, to an alloying treatment following a galvanizing treatment.

According to aspects of the present invention, it is possible to obtain a high-strength galvanized steel sheet excellent in terms of coating adhesiveness, workability, and fatigue resistance.

BRIEF DESCRIPTION OF DRAWINGS

The FIGURE is a diagram illustrating the relationship between $H_2O$ concentration variations in a heating zone for reduction annealing and alloying temperature.

DETAILED DESCRIPTION OF EMBODIMENTS OF THE INVENTION

Hereafter, embodiments of the present invention will be specifically described.

Here, in the description below, the contents of the constituents of the chemical composition of steel and the contents of the constituents of the chemical composition of a coating layer are all expressed in units of "mass %", and "mass %" is referred to as "%", unless otherwise noted. In addition, the $O_2$ concentration, the $H_2O$ concentration, and the $H_2$ concentration are all expressed in units of "vol. %" or "vol·ppm", and "vol. %" and "vol·ppm" are respectively referred to as "%" and "ppm", unless otherwise noted.

The chemical composition of steel will be described.

C: 0.3% or less

Since there is a deterioration in weldability in the case where the C content is more than 0.3%, the C content is set to be 0.3% or less. On the other hand, C facilitates improving workability through the formation of, for example, a retained austenite phase (hereinafter, also referred to as a "retained γ phase") and a martensite phase in a steel microstructure. Therefore, it is preferable that the C content be 0.025% or more.

Si: 0.1% to 2.5%

Si is an element which is effective for achieving good material properties by increasing the strength of steel. It is not preferable that the Si content be less than 0.1% from an economic point of view, because this results in expensive alloy elements being necessary to achieve satisfactory high strength. On the other hand, it is known that an oxidation reaction is inhibited when an oxidizing treatment is performed on Si-containing steel. Therefore, in the case where the Si content is more than 2.5%, the formation of an oxide film is inhibited in the oxidizing treatment. In addition, since there is an increase in alloying temperature, it is difficult to achieve the desired mechanical properties. Therefore, the Si content is set to be 0.1% or more and 2.5% or less.

Mn: 0.5% to 3.0%

Mn is an element which is effective for increasing the strength of steel. The Mn content is set to be 0.5% or more to achieve satisfactory mechanical properties and strength. On the other hand, in the case where the Mn content is more than 3.0%, there may be a case where it is difficult to achieve satisfactory weldability, coating adhesiveness, and strength-ductility balance. Therefore, the Mn content is set to be 0.5% or more and 3.0% or less.

P: 0.100% or less

P is an element which is effective for increasing the strength of steel. However, in the case where the P content is more than 0.100%, since embrittlement occurs due to grain-boundary segregation, there may be a deterioration in impact resistance. Therefore, the P content is set to be 0.100% or less.

S: 0.0100% or less

S causes a deterioration in impact resistance and cracking to occur along the metal flow of a weld as a result of forming inclusions such as MnS. Therefore, it is preferable that the S content be as small as possible. Therefore, the S content is set to be 0.0100% or less.

The remainder is Fe and inevitable impurities.

Here, to control strength-ductility balance, one, two, or more selected from Al: 0.01% to 0.1%, Mo: 0.05% to 1.0%, Nb: 0.005% to 0.05%, Ti: 0.005% to 0.05%, Cu: 0.05% to 1.0%, Ni: 0.05% to 1.0%, Cr: 0.01% to 0.8%, B: 0.0005% to 0.005%, Sb: 0.001% to 0.10%, and Sn: 0.001% to 0.10% may be added as needed.

In the case where these elements are added, the reasons for the limitation on the appropriate contents of these elements are as follows.

Since, thermodynamically, Al is most likely to be oxidized, Al is oxidized more readily than Si and Mn. Therefore, Al is effective for promoting internal oxidation of a steel sheet by inhibiting the oxidation of Si and Mn on the surface of the steel sheet. Such an effect is realized in the case where the Al content is 0.01% or more. On the other hand, in the case where the Al content is more than 0.1%, there is an increase in cost. Therefore, in the case where Al is added, it is preferable that the Al content be 0.01% or more and 0.1% or less.

In the case where the Mo content is less than 0.05%, it is difficult to realize the effect of controlling strength and the effect of improving coating adhesiveness which is realized when Mo is added in combination with Nb, Ni, and Cu. On the other hand, in the case where the Mo content is more than 1.0%, there is an increase in cost. Therefore, in the case where Mo is added, it is preferable that the Mo content be 0.05% or more and 1.0% or less.

In the case where the Nb content is less than 0.005%, it is difficult to realize the effect of controlling strength and the effect of improving coating adhesiveness which is realized when Nb is added in combination with Mo. On the other hand, in the case where the Nb content is more than 0.05%, there is an increase in cost. Therefore, in the case where Nb is added, it is preferable that the Nb content be 0.005% or more and 0.05% or less.

In the case where the Ti content is less than 0.005%, it is difficult to realize the effect of controlling strength. In the case where the Ti content is more than 0.05%, there is a deterioration in coating adhesiveness. Therefore, in the case where Ti is added, it is preferable that the Ti content be 0.005% or more and 0.05% or less.

In the case where the Cu content is less than 0.05%, it is difficult to realize the effect of promoting the formation of a retained γ phase and the effect of improving coating adhesiveness which is realized when Cu is added in combination with Ni and Mo. On the other hand, in the case where the Cu content is more than 1.0%, there is an increase in cost. Therefore, in the case where Cu is added, it is preferable that the Cu content be 0.05% or more and 1.0% or less.

In the case where the Ni content is less than 0.05%, it is difficult to realize the effect of promoting the formation of a retained γ phase and the effect of improving coating adhesiveness which is realized when Ni is added in combination with Cu and Mo. On the other hand, in the case where the Ni content is more than 1.0%, there is an increase in cost. Therefore, in the case where Ni is added, it is preferable that the Ni content be 0.05% or more and 1.0% or less.

In the case where the Cr content is less than 0.01%, since it is difficult to achieve satisfactory hardenability, there may be a deterioration in strength-ductility balance. On the other hand, in the case where the Cr content is more than 0.8%, there is an increase in cost. Therefore, in the case where Cr is added, it is preferable that the Cr content be 0.01% or more and 0.8% or less.

B is an element which is effective for improving the hardenability of steel. In the case Where the B content is less than 0.0005%, it is difficult to realize a quenching effect. In the case where the B content is more than 0.005%, since the oxidation of Si on the outermost surface of a steel sheet is promoted, there is a deterioration in coating adhesiveness. Therefore, in the case where B is added, it is preferable that the B content be 0.0005% or more and 0.005% or less.

Sb and Sn are elements which are effective for inhibiting a decrease in the strength of steel by inhibiting, for example, denitrification and boron removal. It is preferable that the content of each of Sb and Sn be 0.001% or more to realize such an effect. On the other hand, in the case where the content of each of Sb and Sn is more than 0.10%, there is a deterioration in impact resistance. Therefore, in the case where Sb and Sn are added, it is preferable that the content of each of Sb and Sn be 0.001% or more and 0.10% or less.

Hereafter, the method for manufacturing a high-strength galvanized steel sheet according to aspects of the present invention will be described. In accordance with aspects of the present invention, a galvanizing treatment is performed on a steel sheet having the chemical composition described above after an oxidizing treatment followed by reduction annealing has been performed. In addition, an alloying treatment is optionally performed.

Heating in a first half of an oxidizing treatment is performed at a temperature of 400° C. to 750° C. in an atmosphere having an $O_2$ concentration of 1000 vol·ppm or more and an $H_2O$ concentration of 1000 vol·ppm or more, and heating in a second half of the oxidizing treatment is performed at a temperature of 600° C. to 850° C. in an atmosphere having an $O_2$ concentration of less than 1000 vol·ppm and an $H_2O$ concentration of 1000 vol·ppm or more. Heating in a heating zone for the reduction annealing is performed to a temperature of 650° C. to 900° C. at a heating rate of 0.1° C./sec or more in an atmosphere having an $H_2$ concentration of 5 vol. % or more and 30 vol. % or less and an $H_2O$ concentration of 500 vol·ppm or more and 5000 vol·ppm or less with the balance being $N_2$ and inevitable impurities, and soaking in a soaking zone for reduction annealing is performed with a temperature variation of within ±20° C. for 10 seconds to 300 seconds in an atmosphere having an $H_2$ concentration of 5 vol. % or more and 30 vol. % or less and an $H_2O$ concentration of 10 vol·ppm or more and 1000 vol·ppm or less with the balance being $N_2$ and inevitable impurities.

It is preferable that the galvanizing treatment be performed in a galvanizing bath having a chemical composition having an effective Al concentration in the bath of 0.095 mass % to 0.175 mass % with the balance being Zn and inevitable impurities.

It is preferable that the alloying treatment be performed at a temperature T which satisfies the relational expression below for 10 seconds to 60 seconds.

$$-50\log([H_2O])+660 \leq T \leq -40\log([H_2O])+690$$

Here, $[H_2O]$ denotes the $H_2O$ concentration (ppm) in the heating zone for reduction annealing.

First, an oxidizing treatment will be described. To increase the strength of a steel sheet, adding Si, Mn, and so forth to steel is effective, as described above. However, in the case of a steel sheet containing such elements, since the oxides of Si and Mn are formed on the surface of the steel sheet in an annealing process (oxidizing treatment+reduction annealing), which is performed before a galvanizing treatment is performed, it is difficult to achieve sufficient zinc coatability.

From the results of investigations, it was found that, by controlling the conditions of the annealing (oxidizing treatment+reduction annealing), which is performed before a galvanizing treatment is performed, to internally oxidize Si and Mn of a steel sheet so that the oxidation of Si and Mn on the surface of the steel sheet is prevented, there is an improvement in zinc coatability, and it is possible to increase the reactivity between a coating layer and the steel sheet, resulting in an improvement in coating adhesiveness.

In addition, it was found that, to internally oxidize Si and Mn of a steel sheet so that the oxidation of Si and Mn on the surface of the steel sheet is prevented, performing an oxidizing treatment followed by reduction annealing and a galvanizing treatment with an alloying treatment being further performed as needed is effective, and it is necessary to form a certain amount or more of iron oxides in the oxidizing treatment.

However, in the case where reduction annealing is performed with a certain amount or more of iron oxides formed in the oxidizing treatment being left as is, there is a problem of a pickup phenomenon occurring. Therefore, it is important that the oxidizing treatment be divided into a first half and a second half and that an $O_2$ concentration in an atmosphere be controlled in each of the two halves. In particular, it is important that an oxidizing treatment in the second half be performed with a low $O_2$ concentration. Hereafter, an oxidizing treatment in the first half and an oxidizing treatment in the second half will be described.

First-Half Treatment

To promote the formation of iron oxides on the surface of a steel sheet by inhibiting the oxidation of Si and Mn, an oxidizing treatment is actively performed. For this purpose, it is necessary that the $O_2$ concentration be 1000 ppm or more to form a sufficient amount of iron oxides. Although there is no particular limitation on the upper limit of the $O_2$ concentration, it is preferable that the upper limit be 20% or less of the $O_2$ concentration in atmospheric air for economic reasons regarding cost for feeding oxygen. In addition, since $H_2O$ is, like $O_2$, effective for promoting the oxidation of iron, the $H_2O$ content is set to be 1000 ppm or more. Although there is no particular limitation on the upper limit of the $H_2O$ content, it is preferable that the upper limit be 30% or less for economic reasons regarding humidification cost. Moreover, it is necessary that the heating temperature be 400° C. or higher to promote the oxidation of iron. On the other hand, in the case where the heating temperature is higher than 750° C., excessive oxidation of iron occurs, which results in pickup occurring in the next process. Therefore, the heating temperature is set to be 400° C. or higher and 750° C. or lower.

Second-Half Treatment

This is an important factor for achieving good aesthetic surface appearance without dent flaws or the like by preventing pickup from occurring in accordance with aspects of the present invention. To prevent pickup from occurring, it is important to perform a reduction treatment on a part of the surface (surface layer) of a steel sheet which has been oxidized. To perform such a reduction treatment, it is necessary that an $O_2$ concentration be controlled to be less than 1000 ppm. By decreasing the $O_2$ concentration, since a part of the surface of the iron oxide layer is reduced, direct contact between the rolls in the annealing furnace and the iron oxide layer is avoided in the subsequent reduction annealing process, which results in pickup being prevented from occurring. Since such a reduction reaction is less likely to occur in the case where the $O_2$ concentration is 1000 ppm or more, the $O_2$ concentration is set to be less than 1000 ppm. In addition, an $H_2O$ concentration is set to be 1000 ppm or more to promote the internal oxidation of Si and Mn described below. Although there is no particular limitation on the upper limit of the $H_2O$ concentration, it is preferable that the upper limit be 30% or less for economic reasons regarding humidification cost as in the case of the first-half oxidizing treatment. In the case where the heating temperature is lower than 600° C., a reduction reaction is less likely to occur. In the case where the heating temperature is higher than 850° C., the effect of promoting the reduction reaction becomes saturated, and there is also an increase in heating cost. Therefore, the heating temperature is set to be 600° C. or higher and 850° C. or lower.

As described above, it is necessary that the oxidation furnace be composed of at least 2 zones in which it is possible to separately control the atmospheres thereof to satisfy the conditions described above. In the case where the oxidation furnace is composed of 2 zones, the respective 2 zones may be used for the first-half treatment and the second-half treatment, and the atmosphere control may be performed as described above. In the case where the oxidation furnace is composed of 3 or more zones, any consecutive zones may be regarded as one zone so that atmosphere control is performed in the same manner in such consecutive zones. In addition, the first-half treatment and the second-half treatment may be performed separately in different oxidation furnaces. However, in consideration of, for example, industrial productivity and the utilization of an existing production line with modification, it is preferable that one furnace be divided into 2 or more zones so that atmosphere control is performed separately in each of the zones.

In addition, it is preferable that the first-half oxidizing treatment and the second-half oxidizing treatment be performed by using a direct fired furnace (DFF) or a non-oxidation furnace (NOF). A DFF and a NOF are furnaces which are used in many galvanizing lines and with which it is possible to easily perform $O_2$ concentration control by controlling the air ratio. In addition, it is preferable that a DFF or a NOF be used from the viewpoint of, for example, production efficiency, because of a decrease in the length of the heating furnace and an increase in line speed due to an increase in the heating rate of a steel sheet. A direct fired furnace (DFF) and a non-oxidation furnace (NOF) are used to heat a steel sheet by burning a mixture of a fuel such as coke oven gas (COG), which is a by-product gas from steel plants, and air. Therefore, in the case where the ratio of the amount of air to the amount of the fuel is large, since unburnt oxygen is retained in the flames, it is possible to promote the oxidation of a steel sheet. Therefore, by controlling the air ratio, it is possible to control the oxygen concentration in the atmosphere. In the first-half oxidizing treatment, there may be a case where the atmosphere condition described above is not satisfied when the air ratio is less than 1.0, and there may be a case where excessive oxidation of iron occurs when the air ratio is 1.3 or more. Therefore, it is preferable that the air ratio be 1.0 or more and less than 1.3. In addition, in the second-half oxidizing treatment, there may be a case where the atmosphere condition described above is not satisfied when the air ratio is 0.9 or more, and there may be a case where there is an increase in cost due to an increase in the ratio of a combustion gas for heating used when the air ratio is less than 0.7. Therefore, it is preferable that the air ratio be 0.7 or more and less than 0.9.

Hereafter, reduction annealing, which is performed following the oxidizing treatment, will be described.

In the reduction annealing, the iron oxides formed on the surface of a steel sheet during the oxidizing treatment are reduced, and the internal oxides of alloy elements such as Si and Mn are formed inside the steel sheet by using oxygen provided from the iron oxides. As a result, a reduced iron layer is formed by reducing the iron oxides on the outermost surface layer of the steel sheet, and Si and Mn remain in the steel sheet in the form of internal oxides. Therefore, since the oxidation of Si and Mn on the surface of the steel sheet is inhibited, it is possible to prevent a deterioration in wettability between the steel sheet and molten zinc and to achieve good coating surface appearance without any bare spot. As a result, since there is an improvement in reactivity between the steel sheet and a coating layer, there is an improvement in coating adhesiveness. In addition, in a region of the surface layer of the steel sheet, in which internal oxides are formed, there is a decrease in the amount of solute Si. As a result of a decrease in the amount of solute Si, since the surface layer of the steel sheet substantially behaves as low-Si steel, a subsequent alloying reaction is promoted, which results in an alloying reaction progressing at a low temperature. As a result of a decrease in alloying temperature, since the volume fraction of a retained austenite phase is maintained at a high value, there is an improvement in ductility. Since the temper softening of a martensite phase does not progress, it is possible to achieve the desired strength.

However, from the results of investigations, it was found that, although good coating surface appearance is achieved, since the formation of oxides of Si and/or Mn on the surface of a steel sheet is not sufficiently inhibited, it is not possible to achieve the desired coating adhesiveness in the case of a galvanized steel sheet, which is not subjected to an alloying treatment. In addition, in the case where a galvannealed steel sheet is manufactured, it was found that, since there is an increase in alloying temperature, the decomposition of a retained austenite phase into a pearlite phase and the temper softening of a martensite phase occur, which makes it impossible to achieve the desired mechanical properties.

Therefore, investigations were conducted to achieve good coating adhesiveness and to decrease an alloying temperature. As a result, a technique was devised in which, by more actively forming the internal oxides of Si and Mn, the formation of oxides of Si and Mn in the surface layer of a steel sheet is more strongly inhibited to improve the coating adhesiveness of a galvanized steel sheet, which is not subjected to an alloying treatment, and the amount of solute Si in the surface layer of the steel sheet is further decreased to promote an alloying reaction when an alloying treatment is performed.

In order to more actively form the internal oxides of Si and Mn, controlling an $H_2O$ concentration in an atmosphere in the heating zone of a reduction annealing furnace to be 500 ppm or more is effective, and this is a particularly important requirement in accordance with aspects of the present invention. Hereafter, a heating zone and a soaking zone for reduction annealing will be described.

Heating Zone for Reduction Annealing

As described above, it was found that, by inhibiting the reduction reaction of iron oxides, since a larger amount of oxygen is provided from the iron oxides, the internal oxidation of Si and Mn is promoted. To realize such an effect, controlling the $H_2O$ concentration to be 500 ppm or more in a heating zone is effective. By controlling the $H_2O$ concentration to be 500 ppm or more, since the internal oxides of Si and Mn are more actively formed, the formation of oxides of Si and Mn on the surface of a steel sheet is more strongly inhibited. Although internal oxidation progresses more readily at crystal grain boundaries, it is preferable that the $H_2O$ concentration be more than 1000 ppm to further promote internal oxidation within crystal grains. On the other hand, in the case where the $H_2O$ concentration is more than 5000 ppm, since an excessive decarburized layer is formed, there is a deterioration in fatigue resistance. In addition, there is an increase in cost for humidification. Therefore, the upper limit of $H_2O$ concentration is set to be 5000 ppm. It is preferable that the $H_2O$ concentration be 4000 ppm or less to achieve excellent fatigue resistance. For these reasons, the $H_2O$ concentration is set to be 500 ppm or more and 5000 ppm or less. It is preferable that the $H_2O$ concentration be more than 1000 ppm. It is preferable that the $H_2O$ concentration be 4000 ppm or less.

An $H_2$ concentration is set to be 5% or more and 30% or less. The $H_2$ concentration is set to be 5% or more to reduce, to some extent, iron oxides formed on the surface of a steel sheet in an oxidizing treatment. In the case where the $H_2$ concentration is less than 5%, since the reduction reaction of the iron oxides is excessively inhibited, iron oxides are not completely reduced, which raises a risk of pickup and bare spot defects occurring. In the case where the $H_2$ concentration is more than 30%, there is an increase in cost. The remainder which is different from $H_2O$ and $H_2$ is $N_2$ and inevitable impurities.

The steel sheet needs to be further heated to a certain temperature to achieve the desired mechanical properties such as tensile strength (TS) and elongation (El). For this purpose, a heating rate is set to be 0.1° C./sec or more. In the case where the heating rate is less than 0.1° C./sec, it is not possible to heat the steel sheet to a temperature range in which the desired mechanical properties are achieved. It is preferable that the heating rate be 0.5° C./sec or more, because this makes it possible to perform heating in a short heating line in a short time. Although there is no particular limitation on the upper limit of the heating rate, since there is an increase in energy cost in the case where the heating rate is more than 10° C./sec, it is preferable that the heating rate be 10° C./sec or less.

The heating temperature is set to be 650° C. to 900° C. In the case where the heating temperature is lower than 650° C., it is not possible to achieve the desired mechanical properties such as TS and El. In addition, in the case where the heating temperature is higher than 900° C., it is not possible to achieve the desired mechanical properties.

It is preferable that the difference in $H_2O$ concentration between the upper and lower parts of the heating zone of reduction annealing furnace be 2000 ppm or less.

There is a tendency for the $H_2O$ concentration distribution in a reduction annealing furnace to be high in the upper part of the annealing furnace and to be low in the lower part of the furnace in general, although it depends of the structure of the reduction annealing furnace. In the case of a vertical annealing furnace which is mainly used in a galvanizing line, when there is a large difference in $H_2O$ concentration between the upper and lower parts, since a steel sheet passes alternately through regions having a high $H_2O$ concentration and regions having a low $H_2O$ concentration, it is difficult to homogeneously form internal oxides within crystal grains. To control $H_2O$ concentration distribution to be as homogeneous as possible, it is preferable that the difference in $H_2O$ concentration between the upper and lower parts of the annealing furnace be 2000 ppm or less. In the case where the difference in $H_2O$ concentration between the upper and lower parts is more than 2000 ppm, there may be a case where it is difficult to homogeneously form internal oxides. In the case where an attempt is made to control the $H_2O$ concentration in the lower part, in which the $H_2O$ concentration is low, to be within the range according to aspects of the present invention, since it is necessary to feed an excessive amount of $H_2O$, there is an increase in cost. Here, the expression "$H_2O$ concentration in the upper or lower part of an annealing furnace" refers to the $H_2O$ concentration determined in the upper or lower part constituting the 20% of the overall height of the annealing furnace.

Soaking zone for reduction annealing By controlling the $H_2O$ concentration to be high in the heating zone to form sufficient amounts of internal oxides of Si and Mn, a solute-Si-depleted layer and a solute-Mn-depleted layer are formed in the surface layer of the steel sheet. Therefore, in a soaking zone, since Si and Mn are less likely to diffuse to the surface of the steel sheet even if the $H_2O$ concentration is not so high, it is possible to sufficiently inhibit the oxidation of Si and Mn in the surface layer of the steel sheet. For example, Patent Literature 12 discloses a technique in which the $H_2O$ concentration in the whole annealing furnace is controlled to be 500 vol·ppm to 5000 vol·ppm. However, in the case where the $H_2O$ concentration is high in the soaking zone of the annealing furnace, since an excessively decarburized layer is formed, there is a deterioration in fatigue resistance. Moreover, in the case where the $H_2O$ concentration is high in the soaking zone, in which the temperature is controlled to be high, there is a risk of a decrease in the service life of the furnace body. For these reasons, it is preferable that the $H_2O$ concentration be as low as possible in the soaking zone. Therefore, in accordance with aspects of the present invention, the $H_2O$ concentration in the soaking zone is set to be 1000 ppm or less, or preferably less than 500 ppm. On the other hand, in the case where an attempt is made to control the $H_2O$ concentration to be less than 10 ppm, since it is necessary to dehumidify the atmosphere gas, there is an increase in equipment cost for dehumidification. Therefore, the lower limit of the $H_2O$ concentration is set to be 10 ppm.

As described above, in the heating zone, the $H_2O$ concentration is controlled to be high to more actively form the internal oxides of Si and Mn. On the other hand, in the soaking zone, the $H_2O$ concentration is controlled to be low to prevent a deterioration in fatigue resistance and a decrease in the service life of the furnace body. To realize such effects to a higher degree, it is preferable the relational expression ($H_2O$ concentration in heating zone)>($H_2O$ concentration in soaking zone) be satisfied in reduction annealing.

The $H_2$ concentration is set to be 5% or more and 30% or less. In the case where the $H_2$ concentration is less than 5%, the reduction of iron oxides and natural oxide film, which have not been completely reduced in the heating zone, is inhibited, which raises a risk of pickup and bare spot defects occurring. In the case where the $H_2$ concentration is more than 30%, there is an increase in cost. The remainder which is different from $H_2O$ and $H_2$ is $N_2$ and inevitable impurities.

Since it is not possible to achieve the desired mechanical properties such as TS and El in the case where the temperature variation in the soaking zone is not within ±20° C., the temperature variation in the soaking zone is set to be within ±20° C. For example, by individually controlling the temperatures of plural radiant tubes, which are used for heating in an annealing furnace, it is possible to control the temperature variation in the soaking zone to be within ±20° C.

The soaking time in the soaking zone is set to be 10 seconds to 300 seconds. In the case where the soaking time is less than 10 seconds, it is not possible to sufficiently form a metallographic structure, which is necessary to achieve the desired mechanical properties such as TS and El. In addition, in the case where the soaking time is more than 300 seconds, there is a deterioration in productivity, or a long furnace is necessary.

Although there is no particular limitation on the method used for controlling the $H_2O$ concentration in a reduction annealing furnace, the examples of such a method include one in which heated steam is fed into the furnace and one in which $N_2$ gas and/or $H_2$ gas which are humidified by using, for example, a bubbling method are fed into the furnace. In addition, it is preferable that a membrane-exchange type humidifying method utilizing a hollow fiber membrane be used, because this increases further dew-point temperature controllability.

Hereafter, a galvanizing treatment and an alloying treatment will be described.

As described above, it was found that, by controlling the conditions in the oxidizing treatment process and the reduction annealing process to actively form internal oxides of Si, an alloying reaction is promoted. Then, a first-half oxidizing treatment, a second-half oxidizing treatment, and reduction annealing were performed in this order on a steel sheet containing 0.12% of C, 1.5% of Si, and 2.7% of Mn, in which the first-half oxidizing treatment was performed at a temperature of 650° C. in an atmosphere having an $O_2$ concentration of 1000 ppm or more and an $H_2O$ concentration of 1000 ppm or more, in which the second-half oxidizing treatment was performed at a temperature of 700° C. in an atmosphere having an $O_2$ concentration of less than 1000 ppm and an $H_2O$ concentration of 1000 ppm or more, in which heating in the heating zone of a reduction annealing furnace was performed to a heating temperature of 850° C. at a heating rate of 1.5° C./sec in an atmosphere having a controlled $H_2O$ concentration and an $H_2$ concentration of 15%, and in which soaking in the soaking zone was performed with a temperature variation of −10° C. for 130 seconds in an atmosphere having an $H_2$ concentration of 15% and an $H_2O$ concentration of 300 ppm. Subsequently, a galvanizing treatment followed by an alloying treatment at a temperature of 450° C. to 600° C. for 25 seconds was performed to investigate the relationship between the $H_2O$ concentration variations in the heating zone and the alloying temperature. The obtained results are given in the FIGURE. In the FIGURE, symbol ♦ denotes a temperature at which an alloying reaction has been completed, that is, a ■ phase formed before the alloying treatment is performed has been completely changed into an Fe—Zn alloy. In addition, symbol U denotes the upper limit of a temperature at which coating adhesiveness corresponding to rank 3 is achieved when coating adhesiveness is evaluated by using the method described in EXAMPLE 1 below. In addition, the lines in the FIGURE show the upper and lower limits of an alloying temperature expressed by the following relational expression.

From the FIGURE, the following knowledge was obtained. In the case where the alloying temperature is lower than $(-50 \log([H_2O])+660)$° C., since alloying does not completely progress, an η phase is retained. In the case where an η phase is retained, there is a deterioration in surface appearance due to a variation in color tone on the surface, and there is a deterioration in press formability due to an increase in the friction coefficient of the surface of a coating layer. In addition, in the case where the alloying temperature is higher than $(-40 \log([H_2O])+690)$° C., it is not possible to achieve good coating adhesiveness. Moreover, as indicated in the FIGURE, it is clarified that the required alloying temperature decreases, that is, reactivity to form an Fe—Zn alloy increases, with an increase in $H_2O$ concentration. In addition, the effect of improving mechanical properties with an increase in $H_2O$ concentration in a reduction annealing furnace described above is caused by such a decrease in alloying temperature. It is clarified that, to achieve the desired mechanical properties such as TS and El, it is also necessary to precisely control alloying temperature after a galvanizing treatment has been performed.

For the reasons described above, it is preferable that an alloying treatment be performed at a temperature T which satisfies the relational expression below.

$$-50 \log([H_2O])+660 \leq T \leq -40 \log([H_2O])+690$$

Here, $[H_2O]$ denotes the $H_2O$ concentration (ppm) in the heating zone for reduction annealing.

In addition, the alloying time is set to be 10 seconds to 60 seconds for the reasons as in the case of the alloying temperature.

Although there is no particular limitation on the degree of alloying after the alloying treatment has been performed, η is preferable that the degree of alloying be 7 mass % to 15 mass %. There is a deterioration in press formability due to an η phase being retained in the case where the degree of alloying is less than 7 mass %, and there is a deterioration in coating adhesiveness in the case where the degree of alloying is more than 15 mass %.

It is preferable that the galvanizing treatment be performed in a galvanizing bath having a chemical composition having an effective Al concentration in the bath of 0.095% to 0.175% (or more preferably 0.095% to 0.115% in the case where an alloying treatment is performed) with the balance being Zn and inevitable impurities. Here, the term "effective Al concentration in the bath" refers to a value calculated by subtracting an Fe concentration in the bath from an Al concentration in the bath. Although Patent Literature 10 discloses a technique in which an alloying reaction is promoted by decreasing the effective Al concentration in the bath to 0.07% to 0.092%, aspects of the present invention provide a technique in which an alloying reaction is promoted without decreasing the effective Al concentration in the bath. In the case where the effective Al concentration in the bath is less than 0.095%, since a Γ phase, which is a hard and brittle Fe—Zn alloy, is formed at the interface between a steel sheet and a coating layer after an alloying treatment has been performed, there may be a deterioration in coating adhesiveness. On the other hand, in the case where the effective Al concentration in the bath is more than 0.175%, since there is an increase in alloying temperature even if aspects of the present invention are used, it is not possible to achieve the desired mechanical properties such as TS and El, and there is an increase in the amount of dross generated in the bath, which results in a problem of surface defects due to the dross adhering to a steel sheet. In addition, there is an increase in cost for adding Al. In the case where the effective Al concentration in the bath is more than 0.115%, since there is an increase in alloying temperature even if aspects of the present invention are used, there may be a case where it is not possible to achieve the desired mechanical properties. Therefore, it is preferable that the effective Al concentration in the bath be 0.095% or more and 0.175% or less. It is more preferable that the effective Al concentration in the bath be 0.115% or less in the case where an alloying treatment is performed.

Although, there is no particular limitation on the other conditions used for the galvanizing treatment, for example, the temperature of a galvanizing bath may be 440° C. to 500° C. as in the case of an ordinary method, a steel sheet may be dipped in a galvanizing bath when the steel sheet has a temperature of 440° C. to 550° C., and coating weight may be controlled by using a gas wiping method.

Example 1

Molten steels having the chemical compositions given in Table 1 were prepared and made into cast pieces, and the cast pieces were made into cold rolled steel sheets having a thickness of 1.2 mm by performing hot rolling, pickling, and cold rolling.

TABLE 1

(mass %)

| Steel Grade | C | Si | Mn | P | S | Other |
|---|---|---|---|---|---|---|
| A | 0.12 | 1.5 | 2.7 | 0.01 | 0.001 | Ti: 0.02, B: 0.001 |
| B | 0.07 | 0.3 | 1.7 | 0.03 | 0.001 | Mo: 0.1, Nb: 0.01, Cu: 0.2 |
| C | 0.15 | 0.8 | 1.8 | 0.01 | 0.001 | Al: 0.07, Cr: 0.3 |
| D | 0.08 | 1.5 | 1.4 | 0.01 | 0.001 | Ni: 0.3, Sb: 0.01 |
| E | 0.12 | 1.4 | 1.9 | 0.01 | 0.001 | |
| F | 0.09 | 0.2 | 2.3 | 0.01 | 0.001 | Mo: 0.1, Cr: 0.6, Nb: 0.04, B: 0.001, Ti: 0.02 |
| G | 0.18 | 2.1 | 2.8 | 0.01 | 0.001 | Sn: 0.01 |
| H | 0.09 | 2.7 | 1.5 | 0.01 | 0.001 | Ti: 0.02, Mo: 0.1 |
| I | 0.06 | 0.3 | 3.2 | 0.01 | 0.001 | |

Subsequently, after first-half and second-half oxidation treatments had been performed by using a CGL having a DFF-type oxidation furnace or a NOF-type oxidation furnace under the conditions given in Table 2, reduction annealing was performed under the conditions given in Table 2. Subsequently, after a galvanizing treatment had been performed by using baths having the effective Al concentrations in bath given in Table 2 and a temperature of 460° C., coating weight was controlled to be approximately 50 g/m$^2$ per side by using a gas wiping method, and an alloying treatment was then performed under the conditions regarding temperature and time given in Table 2.

The surface appearance quality and coating adhesiveness of the galvanized steel sheets (including galvannealed steel sheets) obtained as described above were evaluated. Moreover, investigations regarding tensile properties and fatigue resistance were conducted. The determination methods and the evaluation methods will be described hereafter.

Surface Appearance Quality

The surface appearance of the steel sheets manufactured as described above was observed by performing a visual test, and a case where poor surface appearance such as a variation in the degree of alloying, a bare spot, or a dent flaw due to, for example, pickup was not observed was determined as "O", a case where surface appearance is generally good with a little of poor surface appearance was determined as "A", and a case where a variation in the degree of alloying, a bare spot, or a dent flaw was observed was determined as "x".

Coating Adhesiveness (Galvanized Steel Sheet without Alloying Treatment)

When, after the coated steel sheet had been bent by using a mold having a tip R of 2.0 mm and a tip angle of 90°, a cellophane tape (registered trademark) was stuck to the surface on the outer side of the bent portion and then peeled, a case where the separation of a coating layer was not observed was determined as "○", a case where the separation of a coating layer having a size of 1 mm or less was observed or a case where the bond between the steel sheet and a coating layer was loosened with no coating layer adhering to the tape was determined as "Δ", and a case where a coating layer having a size of more than 1 mm was separated and adhered to the tape was determined as "x".

(Galvannealed Steel Sheet)

A cellophane tape (registered trademark) was stuck to the surface of the coated steel sheet, the steel sheet was bent at an angle of 90° and unbent, and a cellophane tape having a width of 24 mm was stuck to the surface on the inner side (compressed side) of the bent portion in a direction parallel to the bent portion and then peeled. Subsequently, the amount of separated objects on the cellophane tape having a length of 40 mm was determined in terms Zn count number obtained by performing X-ray fluorescence spectrometry, and the determination was conducted in accordance with the criteria below set on the basis of the Zn count number converted to the number per unit length (1 m). A case of rank 1 or 2 was determined as good (○), a case of rank 3 was determined as good (Δ), and a case of rank 4 or 5 was determined as poor (x). Zn count number with fluorescent X-ray: rank 0 or more and less than 500: 1 (good)
500 or more and less than 1000: 2
1000 or more and less than 2000: 3
2000 or more and less than 3000: 4
3000 or more: 5 (poor)

Tensile Properties

Tensile properties were evaluated by using a JIS No. 5 tensile test piece whose tensile direction was the rolling direction and by using a method in accordance with JIS Z 2241. A case where the value of TS×El was more than 12000 was determined as a case of excellent ductility.

Fatigue Resistance

A fatigue test was performed under the condition of a stress ratio R of 0.05 to obtain a fatigue limit (FL) for a cycle of 107, and an endurance ratio (FL/TS) was calculated. A case of an endurance ratio of 0.60 or more was determined as a case of good fatigue resistance. Here, the term "stress ratio R" refers to a value defined as (minimum cyclic stress)/(maximum cyclic stress).

The results obtained as described above are given in Table 3.

TABLE 2

| | | Oxidizing Treatment | | | | | | | Reduction Annealing Treatment Heating Zone |
|---|---|---|---|---|---|---|---|---|---|
| | | First Half | | | Second Half | | | | |
| No. | Steel Grade | $O_2$ Concentration (vol. ppm) | $H_2O$ Concentration (vol. ppm) | Heating Temperature (° C.) | $O_2$ Concentration (vol. ppm) | $H_2O$ Concentration (vol. ppm) | Heating Temperature (° C.) | Furnace | $H_2$ Concentration (vol. %) |
| 1 | A | 25000 | 20000 | 650 | 400 | 20000 | 710 | DFF | 15 |
| 2 | A | 20000 | 20000 | 630 | 400 | 20000 | 700 | DFF | 15 |
| 3 | A | 20000 | 20000 | 660 | 300 | 20000 | 690 | DFF | 15 |
| 4 | A | 2000 | 20000 | 690 | 500 | 20000 | 720 | DFF | 15 |
| 5 | A | 25000 | 20000 | 650 | 400 | 20000 | 690 | DFF | 15 |
| 6 | A | 20000 | 5000 | 660 | 500 | 5000 | 700 | DFF | 15 |
| 7 | A | 10000 | 20000 | 470 | 600 | 20000 | 630 | DFF | 15 |
| 8 | A | 20000 | 20000 | 730 | 200 | 20000 | 830 | DFF | 25 |
| 9 | A | 20000 | 2000 | 640 | 700 | 2000 | 700 | DFF | 15 |
| 10 | A | 20000 | 20000 | 660 | 500 | 20000 | 710 | DFF | 15 |
| 11 | A | 20000 | 10000 | 670 | 900 | 10000 | 710 | DFF | 10 |
| 12 | A | 20000 | 20000 | 650 | 500 | 20000 | 700 | DFF | 15 |
| 13 | A | 5000 | 20000 | 520 | 500 | 20000 | 620 | NOF | 15 |
| 14 | A | 20000 | 20000 | 560 | 500 | 20000 | 660 | NOF | 15 |
| 15 | A | 20000 | 20000 | 620 | 500 | 20000 | 680 | NOF | 15 |
| 16 | A | 20000 | 20000 | 650 | 500 | 20000 | 690 | DFF | 15 |
| 17 | A | 20000 | 20000 | 680 | 500 | 20000 | 720 | DFF | 15 |
| 18 | A | 15000 | 20000 | 650 | 600 | 20000 | 690 | DFF | 15 |
| 19 | A | 20000 | 20000 | 660 | 500 | 20000 | 700 | DFF | 15 |
| 20 | A | 20000 | 20000 | 550 | 600 | 20000 | 620 | DFF | 15 |
| 21 | A | 20000 | 500 | 650 | 500 | 500 | 700 | DFF | 15 |
| 22 | A | 500 | 20000 | 700 | 500 | 20000 | 750 | DFF | 15 |
| 23 | A | 20000 | 20000 | 640 | 2000 | 20000 | 700 | DFF | 15 |
| 24 | A | 20000 | 20000 | 350 | 500 | 20000 | 500 | DFF | 15 |
| 25 | A | 20000 | 20000 | 770 | 500 | 20000 | 870 | DFF | 15 |
| 26 | A | 20000 | 20000 | 660 | 400 | 20000 | 700 | DFF | 15 |
| 27 | A | 20000 | 20000 | 660 | 300 | 20000 | 700 | DFF | 15 |
| 28 | A | 20000 | 20000 | 640 | 500 | 20000 | 680 | DFF | 3 |
| 29 | B | 20000 | 20000 | 520 | 600 | 20000 | 620 | DFF | 15 |
| 30 | B | 20000 | 20000 | 550 | 500 | 20000 | 650 | DFF | 15 |
| 31 | C | 20000 | 20000 | 630 | 600 | 20000 | 680 | DFF | 15 |
| 32 | C | 20000 | 20000 | 560 | 400 | 20000 | 640 | DFF | 15 |
| 33 | D | 20000 | 20000 | 640 | 300 | 20000 | 700 | DFF | 15 |
| 34 | D | 20000 | 20000 | 770 | 500 | 20000 | 860 | DFF | 15 |
| 35 | D | 20000 | 20000 | 660 | 500 | 20000 | 730 | DFF | 15 |
| 36 | E | 20000 | 20000 | 650 | 500 | 20000 | 700 | DFF | 15 |
| 37 | E | 20000 | 20000 | 680 | 400 | 20000 | 740 | DFF | 15 |
| 38 | F | 20000 | 20000 | 620 | 500 | 20000 | 660 | DFF | 15 |
| 39 | G | 20000 | 20000 | 700 | 300 | 20000 | 790 | DFF | 15 |
| 40 | G | 25000 | 20000 | 700 | 500 | 20000 | 790 | DFF | 15 |
| 41 | G | 20000 | 20000 | 710 | 500 | 20000 | 790 | DFF | 15 |
| 42 | H | 20000 | 20000 | 710 | 600 | 20000 | 795 | DFF | 15 |
| 43 | I | 20000 | 20000 | 620 | 400 | 20000 | 700 | DFF | 15 |
| 44 | A | 20000 | 20000 | 660 | 300 | 20000 | 690 | DFF | 15 |
| 45 | A | 20000 | 20000 | 660 | 300 | 20000 | 690 | DFF | 15 |

TABLE 2-continued

| | Reduction Annealing Treatment | | | | | | | |
|---|---|---|---|---|---|---|---|---|
| | Heating Zone | | | | | | Soaking Zone | |
| No. | Upper-part $H_2O$ Concentration (vol. ppm) | Lower-part $H_2O$ Concentration (vol. ppm) | $H_2O$ Concentration Difference (vol. ppm) | Average $H_2O$ Concentration (vol. ppm) | Heating Rate (° C./sec) | Heating Temperature (° C.) | $H_2$ Concentration (vol. %) | $H_2O$ Concentration (vol. ppm) |
| 1 | 2200 | 1400 | 800 | 1800 | 1.2 | 820 | 15 | 500 |
| 2 | 440 | 250 | 190 | 345 | 1.2 | 820 | 15 | 600 |
| 3 | 3600 | 2500 | 1100 | 3050 | 1.2 | 820 | 15 | 500 |
| 4 | 3600 | 2800 | 800 | 3200 | 0.7 | 850 | 15 | 400 |
| 5 | 2500 | 1600 | 900 | 2050 | 1.2 | 820 | 15 | 500 |
| 6 | 4800 | 3300 | 1500 | 4050 | 1.0 | 800 | 15 | 1000 |
| 7 | 1800 | 1500 | 300 | 1650 | 0.8 | 810 | 15 | 200 |
| 8 | 3200 | 1000 | 2200 | 2100 | 0.7 | 880 | 25 | 300 |
| 9 | 4800 | 3500 | 1300 | 4150 | 1.0 | 820 | 15 | 100 |
| 10 | 2800 | 1500 | 1300 | 2150 | 1.5 | 850 | 15 | 300 |
| 11 | 2500 | 1600 | 900 | 2050 | 1.0 | 850 | 10 | 300 |
| 12 | 700 | 500 | 200 | 600 | 1.0 | 800 | 15 | 300 |
| 13 | 700 | 600 | 100 | 650 | 0.7 | 790 | 15 | 500 |
| 14 | 3200 | 2900 | 300 | 3050 | 1.0 | 880 | 15 | 400 |
| 15 | 4000 | 2700 | 1300 | 3350 | 0.6 | 830 | 15 | 400 |
| 16 | 2800 | 1300 | 1500 | 2050 | 0.5 | 800 | 15 | 1500 |
| 17 | 3500 | 2500 | 1000 | 3000 | 1.2 | 850 | 15 | 3000 |
| 18 | 2500 | 1900 | 600 | 2200 | 2.0 | 920 | 15 | 500 |
| 19 | 3500 | 2500 | 1000 | 3000 | 0.6 | 810 | 15 | 600 |
| 20 | 3400 | 1000 | 2400 | 2200 | 0.04 | 640 | 15 | 700 |
| 21 | 2000 | 1300 | 700 | 1650 | 1.5 | 830 | 15 | 700 |
| 22 | 3200 | 2500 | 700 | 2850 | 1.5 | 830 | 15 | 600 |
| 23 | 2800 | 1800 | 1000 | 2300 | 0.5 | 800 | 15 | 300 |
| 24 | 2800 | 1600 | 1200 | 2200 | 2.0 | 630 | 15 | 300 |
| 25 | 3300 | 2700 | 600 | 3000 | 0.3 | 920 | 15 | 400 |
| 26 | 450 | 200 | 250 | 325 | 1.2 | 820 | 15 | 600 |
| 27 | 6500 | 5300 | 1200 | 5900 | 1.0 | 830 | 15 | 600 |
| 28 | 3500 | 2800 | 700 | 3150 | 1.0 | 830 | 3 | 400 |
| 29 | 2500 | 1400 | 1100 | 1950 | 0.5 | 680 | 15 | 300 |
| 30 | 3200 | 2800 | 400 | 3000 | 0.6 | 710 | 15 | 400 |
| 31 | 4300 | 3200 | 1100 | 3750 | 0.8 | 780 | 15 | 300 |
| 32 | 3000 | 2000 | 1000 | 2500 | 0.4 | 750 | 15 | 500 |
| 33 | 2500 | 1800 | 700 | 2150 | 1.0 | 830 | 15 | 300 |
| 34 | 2800 | 1900 | 900 | 2350 | 0.2 | 900 | 15 | 300 |
| 35 | 1900 | 1200 | 700 | 1550 | 0.8 | 850 | 15 | 300 |
| 36 | 2800 | 1500 | 1300 | 2150 | 0.6 | 820 | 15 | 500 |
| 37 | 2400 | 1800 | 600 | 2100 | 0.8 | 830 | 15 | 500 |
| 38 | 1800 | 1400 | 400 | 1600 | 1.3 | 830 | 15 | 600 |
| 39 | 490 | 350 | 140 | 420 | 0.5 | 850 | 15 | 200 |
| 40 | 6300 | 5200 | 1100 | 5750 | 0.5 | 850 | 15 | 300 |
| 41 | 3000 | 2500 | 500 | 2750 | 0.5 | 850 | 15 | 300 |
| 42 | 4200 | 3500 | 700 | 3850 | 0.1 | 820 | 15 | 600 |
| 43 | 4000 | 3000 | 1000 | 3500 | 0.3 | 750 | 15 | 600 |
| 44 | 1300 | 900 | 400 | 1100 | 1.2 | 820 | 15 | 500 |
| 45 | 3600 | 2500 | 1100 | 3050 | 1.2 | 820 | 15 | 480 |

| | Reduction Annealing Treatment Soaking Zone | | | Alloying Treatment | | |
|---|---|---|---|---|---|---|
| No. | Holding time (sec) | Temperature Change in Soaking Zone (° C.) | Galvanizing Effective Al Concentration in Bath (mass %) | Alloying Temperature (° C.) | Alloying Time (sec) | |
| 1 | 92 | −18 | 0.168 | — | — | Example |
| 2 | 100 | −5 | 0.170 | — | — | Comparative Example |
| 3 | 108 | −8 | 0.105 | 515 | 22 | Example |
| 4 | 186 | −10 | 0.105 | 510 | 37 | Example |
| 5 | 108 | −18 | 0.108 | 520 | 22 | Example |
| 6 | 100 | −5 | 0.105 | 505 | 20 | Example |
| 7 | 225 | −7 | 0.097 | 520 | 45 | Example |
| 8 | 71 | −5 | 0.105 | 480 | 14 | Example |
| 9 | 120 | 16 | 0.103 | 510 | 24 | Example |
| 10 | 93 | −5 | 0.102 | 510 | 19 | Example |
| 11 | 140 | 5 | 0.097 | 520 | 28 | Example |
| 12 | 100 | 12 | 0.105 | 560 | 25 | Example |

TABLE 2-continued

| | | | | | | |
|---|---|---|---|---|---|---|
| 13 | 243 | −6 | 0.123 | 570 | 49 | Example |
| 14 | 220 | −8 | 0.090 | 490 | 44 | Example |
| 15 | 250 | −5 | 0.107 | 510 | 50 | Example |
| 16 | 220 | −7 | 0.108 | 540 | 44 | Comparative Example |
| 17 | 108 | −10 | 0.102 | 500 | 22 | Comparative Example |
| 18 | 115 | −13 | 0.105 | 530 | 23 | Comparative Example |
| 19 | 183 | −25 | 0.105 | 510 | 37 | Comparative Example |
| 20 | 500 | −15 | 0.105 | 510 | 100 | Comparative Example |
| 21 | 87 | −6 | 0.101 | 550 | 17 | Comparative Example |
| 22 | 53 | −8 | 0.108 | 530 | 11 | Comparative Example |
| 23 | 200 | −13 | 0.105 | 520 | 40 | Comparative Example |
| 24 | 65 | −3 | 0.103 | 515 | 13 | Comparative Example |
| 25 | 167 | −4 | 0.110 | 510 | 33 | Comparative Example |
| 26 | 100 | −5 | 0.105 | 600 | 20 | Comparative Example |
| 27 | 130 | −2 | 0.105 | 490 | 26 | Comparative Example |
| 28 | 150 | −10 | 0.109 | 530 | 30 | Comparative Example |
| 29 | 120 | −7 | 0.105 | 500 | 24 | Example |
| 30 | 100 | −4 | 0.105 | 490 | 20 | Example |
| 31 | 125 | −5 | 0.105 | 500 | 25 | Example |
| 32 | 275 | −8 | 0.108 | 500 | 55 | Example |
| 33 | 130 | −6 | 0.105 | 520 | 26 | Example |
| 34 | 200 | −2 | 0.105 | 510 | 40 | Comparative Example |
| 35 | 150 | −4 | 0.105 | 520 | 30 | Example |
| 36 | 200 | −10 | 0.105 | 525 | 40 | Example |
| 37 | 113 | −5 | 0.108 | 530 | 23 | Example |
| 38 | 131 | −6 | 0.105 | 510 | 26 | Example |
| 39 | 120 | −6 | 0.105 | 590 | 24 | Comparative Example |
| 40 | 120 | −7 | 0.105 | 520 | 24 | Comparative Example |
| 41 | 120 | −10 | 0.103 | 530 | 24 | Example |
| 42 | 250 | −3 | 0.108 | 530 | 50 | Comparative Example |
| 43 | 167 | −8 | 0.109 | 500 | 33 | Comparative Example |
| 44 | 108 | −8 | 0.105 | 530 | 22 | Example |
| 45 | 108 | −8 | 0.105 | 515 | 22 | Example |

TABLE 3

| No. | Coating Surface Appearance | Coating Adhesiveness | TS (MPa) | TS (MPa) × EL (%) | Endurance Ratio | |
|---|---|---|---|---|---|---|
| 1 | ○ | ○ | 1020 | 14280 | 0.69 | Example |
| 2 | ○ | X | 960 | 14400 | 0.71 | Comparative Example |
| 3 | ○ | ○ | 990 | 13860 | 0.70 | Example |
| 4 | ○ | ○ | 1020 | 13260 | 0.69 | Example |
| 5 | ○ | ○ | 1020 | 14280 | 0.69 | Example |
| 6 | ○ | ○ | 1010 | 13130 | 0.72 | Example |
| 7 | ○ | ○ | 980 | 13720 | 0.71 | Example |
| 8 | Δ | ○ | 980 | 13720 | 0.68 | Example |
| 9 | ○ | ○ | 1015 | 13195 | 0.64 | Example |
| 10 | ○ | ○ | 1008 | 14112 | 0.69 | Example |
| 11 | ○ | ○ | 990 | 12870 | 0.64 | Example |
| 12 | ○ | Δ | 995 | 12935 | 0.65 | Example |
| 13 | ○ | Δ | 1002 | 12024 | 0.65 | Example |
| 14 | ○ | Δ | 1000 | 12000 | 0.62 | Example |
| 15 | ○ | ○ | 980 | 12740 | 0.63 | Example |
| 16 | X | ○ | 1010 | 14140 | 0.56 | Comparative Example |
| 17 | ○ | ○ | 1034 | 13442 | 0.53 | Comparative Example |
| 18 | ○ | ○ | 1010 | 10100 | 0.64 | Comparative Example |
| 19 | ○ | ○ | 920 | 11960 | 0.65 | Comparative Example |
| 20 | X | X | 960 | 10560 | 0.65 | Comparative Example |
| 21 | ○ | X | 1068 | 12816 | 0.75 | Comparative Example |
| 22 | X | X | 989 | 12857 | 0.73 | Comparative Example |
| 23 | X | ○ | 1040 | 13520 | 0.65 | Comparative Example |
| 24 | X | X | 990 | 12870 | 0.64 | Comparative Example |
| 25 | X | ○ | 1050 | 11550 | 0.62 | Comparative Example |
| 26 | ○ | ○ | 960 | 11520 | 0.71 | Comparative Example |
| 27 | ○ | ○ | 980 | 13720 | 0.54 | Comparative Example |
| 28 | X | ○ | 1030 | 12360 | 0.66 | Comparative Example |
| 29 | ○ | ○ | 595 | 13685 | 0.67 | Example |
| 30 | ○ | ○ | 600 | 12600 | 0.67 | Example |
| 31 | ○ | ○ | 805 | 13310 | 0.69 | Example |
| 32 | ○ | ○ | 815 | 13530 | 0.70 | Example |
| 33 | ○ | ○ | 600 | 13200 | 0.67 | Example |
| 34 | X | ○ | 609 | 12180 | 0.66 | Comparative Example |
| 35 | ○ | ○ | 602 | 12642 | 0.68 | Example |
| 36 | ○ | ○ | 810 | 12960 | 0.72 | Example |
| 37 | ○ | ○ | 805 | 13685 | 0.68 | Example |

TABLE 3-continued

| No. | Coating Surface Appearance | Coating Adhesiveness | TS (MPa) | TS (MPa) × EL (%) | Endurance Ratio | |
|---|---|---|---|---|---|---|
| 38 | ○ | ○ | 1008 | 14112 | 0.64 | Example |
| 39 | ○ | ○ | 1115 | 10035 | 0.61 | Comparative Example |
| 40 | X | ○ | 1195 | 13145 | 0.54 | Comparative Example |
| 41 | ○ | ○ | 1200 | 13200 | 0.61 | Example |
| 42 | X | X | 1059 | 14826 | 0.66 | Comparative Example |
| 43 | X | X | 1234 | 11106 | 0.65 | Comparative Example |
| 44 | ○ | ○ | 1020 | 14280 | 0.68 | Example |
| 45 | ○ | ○ | 1010 | 13130 | 0.72 | Example |

As indicated in Table 3, the examples of the present invention were excellent in terms of coating adhesiveness, coating surface appearance, strength-ductility balance, and fatigue resistance despite being high-strength steel containing Si and Mn. On the other hand, the comparative examples, which were manufactured by using methods out of the range of the present invention, were poor in terms of one or more of coating adhesiveness, coating surface appearance, strength-ductility balance, and fatigue resistance.

INDUSTRIAL APPLICABILITY

Since the high-strength galvanized steel sheet according to aspects of the present invention is excellent in terms of coating adhesiveness, workability, and fatigue resistance, it is possible to use the steel sheet as a surface-treated steel sheet to realize the weight reduction and strengthening of automobile bodies.

The invention claimed is:

1. A method for manufacturing a high-strength galvanized steel sheet, the method comprising performing an oxidizing treatment, reduction annealing, and a galvanizing treatment in this order on a steel sheet having a chemical composition containing, by mass %, C: 0.3% or less, Si: 0.1% to 2.5%, Mn: 0.5% to 3.0%, P: 0.100% or less, S: 0.0100% or less, and the balance being Fe and inevitable impurities, wherein heating in a first half of the oxidizing treatment is performed at a temperature of 400° C. or higher and 750° C. or lower in an atmosphere having an $O_2$ concentration of 1000 vol.ppm or more and an $H_2O$ concentration of 1000 vol.ppm or more, wherein heating in a second half of the oxidizing treatment is performed at a temperature of 600° C. or higher and 850° C. or lower in an atmosphere having an $O_2$ concentration of less than 1000 vol.ppm and an $H_2O$ concentration of 1000 vol.ppm or more, wherein heating in a heating zone having an upper part and a lower part for the reduction annealing is performed prior to soaking to raise a temperature of the steel sheet to a temperature of 650° C. or higher and 900° C. or lower at a heating rate of 0.1° C./sec or more in an atmosphere having an $H_2$ concentration of 5 vol. % or more and 30 vol. % or less and an $H_2O$ concentration of 500 vol.ppm or more and 5000 vol.ppm or less with the balance being $N_2$ and inevitable impurities, wherein soaking in a soaking zone for the reduction annealing is performed after the steel sheet exits the heating zone at the temperature of 650° C. or higher and 900° C. or lower to maintain the temperature of the steel sheet with a temperature variation of within ±20° C. for 10 seconds to 300 seconds in an atmosphere having an $H_2$ concentration of 5 vol. % or more and 30 vol. % or less and an $H_2O$ concentration of 10 vol.ppm or more and 1000 vol.ppm or less with the balance being $N_2$ and inevitable impurities, and wherein the $H_2O$ concentration in the heating zone is more than 1000 vol.ppm and 5000 vol.ppm or less, and the $H_2O$ concentration in the soaking zone is 10 vol.ppm or more and less than 500 vol.ppm.

2. The method for manufacturing a high-strength galvanized steel sheet according to claim 1, wherein the oxidizing treatment is performed by using a direct fired furnace (DFF) or a non-oxidation furnace (NOF), wherein the first half of the oxidizing treatment is performed with an air ratio of 1.0 or more and less than 1.3, and wherein the second half of the oxidizing treatment is performed with an air ratio of 0.7 or more and less than 0.9.

3. The method for manufacturing a high-strength galvanized steel sheet according to claim 1, wherein a difference in $H_2O$ concentration between upper and lower parts of a furnace in the heating zone for the reduction annealing is 2000 vol.ppm or less.

4. The method for manufacturing a high-strength galvanized steel sheet according to claim 1, wherein the galvanizing treatment is performed in a galvanizing bath having a chemical composition having an effective Al concentration in the bath of 0.095 mass % to 0.175 mass % with the balance being Zn and inevitable impurities.

5. The method for manufacturing a high-strength galvanized steel sheet according to claim 1, wherein the galvanizing treatment is performed in a galvanizing bath having a chemical composition having an effective Al concentration in the bath of 0.095 mass % to 0.115 mass % with the balance being Zn and inevitable impurities, and an alloying treatment is further performed at a temperature T (° C.) which satisfies a relational expression below for 10 seconds to 60 seconds:

$$-50\log([H_2O])+660 \leq T \leq -40\log([H_2O])+690,$$

where $[H_2O]$ denotes the $H_2O$ concentration (vol.ppm) in the heating zone for the reduction annealing.

6. The method for manufacturing a high-strength galvanized steel sheet according to claim 1, wherein the chemical composition further contains, by mass %, one, two, or more of Al: 0.01% to 0.1%, Mo: 0.05% to 1.0%, Nb: 0.005% to 0.05%, Ti: 0.005% to 0.05%, Cu: 0.05% to 1.0%, Ni: 0.05% to 1.0%, Cr: 0.01% to 0.8%, B: 0.0005% to 0.005%, Sb: 0.001% to 0.10%, and
Sn: 0.001% to 0.10%.

7. The method for manufacturing a high-strength galvanized steel sheet according to claim 2, wherein the chemical composition further contains, by mass %, one, two, or more of Al: 0.01% to 0.1%,
Mo: 0.05% to 1.0%,
Nb: 0.005% to 0.05%,
Ti: 0.005% to 0.05%,
Cu: 0.05% to 1.0%,
Ni: 0.05% to 1.0%,
Cr: 0.01% to 0.8%,
B: 0.0005% to 0.005%,
Sb: 0.001% to 0.10%, and
Sn: 0.001% to 0.10%.

8. The method for manufacturing a high-strength galvanized steel sheet according to claim 3, wherein the chemical composition further contains, by mass %, one, two, or more of Al: 0.01% to 0.1%,
Mo: 0.05% to 1.0%,
Nb: 0.005% to 0.05%,
Ti: 0.005% to 0.05%,
Cu: 0.05% to 1.0%,
Ni: 0.05% to 1.0%,
Cr: 0.01% to 0.8%,
B: 0.0005% to 0.005%,
Sb: 0.001% to 0.10%, and
Sn: 0.001% to 0.10%.

9. The method for manufacturing a high-strength galvanized steel sheet according to claim 4, wherein the chemical composition further contains, by mass %, one, two, or more of Al: 0.01% to 0.1%,
Mo: 0.05% to 1.0%,
Nb: 0.005% to 0.05%,
Ti: 0.005% to 0.05%,
Cu: 0.05% to 1.0%,
Ni: 0.05% to 1.0%,
Cr: 0.01% to 0.8%,
B: 0.0005% to 0.005%,
Sb: 0.001% to 0.10%, and
Sn: 0.001% to 0.10%.

10. The method for manufacturing a high-strength galvanized steel sheet according to claim 5, wherein the chemical composition further contains, by mass %, one, two, or more of Al: 0.01% to 0.1%,
Mo: 0.05% to 1.0%,
Nb: 0.005% to 0.05%,
Ti: 0.005% to 0.05%,
Cu: 0.05% to 1.0%,
Ni: 0.05% to 1.0%,
Cr: 0.01% to 0.8%,
B: 0.0005% to 0.005%,
Sb: 0.001% to 0.10%, and
Sn: 0.001% to 0.10%.

* * * * *